US008397789B2

(12) United States Patent
Zoldan

(10) Patent No.: US 8,397,789 B2
(45) Date of Patent: Mar. 19, 2013

(54) PRE-TENSIONED SAND CORE

(76) Inventor: Martin Zoldan, West Bloomfield, MI (US)

( * ) Notice: Subject to any disclaimer, the term of this patent is extended or adjusted under 35 U.S.C. 154(b) by 723 days.

(21) Appl. No.: 11/661,023

(22) PCT Filed: Aug. 25, 2005

(86) PCT No.: PCT/US2005/030392

§ 371 (c)(1),
(2), (4) Date: Feb. 14, 2008

(87) PCT Pub. No.: WO2006/026423

PCT Pub. Date: Mar. 9, 2006

(65) Prior Publication Data

US 2008/0257515 A1 Oct. 23, 2008

Related U.S. Application Data

(60) Provisional application No. 60/604,621, filed on Aug. 25, 2004.

(51) Int. Cl.
*B22C 9/10* (2006.01)

(52) U.S. Cl. ..... 164/6; 164/369; 164/30

(58) Field of Classification Search ..... 164/6, 369, 164/370, 30, 31, 228, 28
See application file for complete search history.

(56) References Cited

U.S. PATENT DOCUMENTS

| | | | | |
|---|---|---|---|---|
| 3,011,232 | A | 12/1961 | Hawkins et al. | |
| 4,217,949 | A | 8/1980 | Wustrow | |
| 5,004,078 | A * | 4/1991 | Oono et al. | 188/218 A |
| 5,962,567 | A | 10/1999 | Geoffrey et al. | |
| 6,773,650 | B1 | 8/2004 | Longo | |
| 2004/0026060 | A1 | 2/2004 | Scott et al. | |
| 2005/0011628 | A1 * | 1/2005 | Frait et al. | 164/132 |

FOREIGN PATENT DOCUMENTS

| | | | |
|---|---|---|---|
| DE | 2505093 | | 8/1976 |
| DE | 3144958 | | 5/1983 |
| FR | 2 625 455 | * | 7/1989 |
| FR | 2625455 | | 7/1989 |
| FR | 2707901 | | 1/1995 |
| JP | 55097844 | | 7/1980 |
| JP | 60223640 | | 11/1985 |
| JP | 63256254 | | 10/1988 |
| WO | PCT/US05/30392 | | 12/2006 |

OTHER PUBLICATIONS

Supplementary European Search Report issued in related application EP 05792459.9 on Sep. 11, 2008.

* cited by examiner

*Primary Examiner* — Kevin P Kerns

(74) *Attorney, Agent, or Firm* — Kohn & Associates, PLLC

(57) ABSTRACT

Provided are methods of replacing drilling holes in castings by pre-tensioning sand cores. These methods are used in long cylindrical shaped sand cores in cold core box processes. The urethane sand core is placed in compression to increase the core strength during handling, placing inside of the mold. The pre-tensioned urethane sand core is set in a casting mold so as to form a cavity in the casting mold. The molten metal is poured to form the cavity inside of the casting. The pre-tensioned urethane sand core maintains its initial shape during casting.

16 Claims, 11 Drawing Sheets

PRE-TENSIONED SAND CORE

CROSS-REFERENCE TO RELATED APPLICATION

This is a U.S. national phase of PCT Application No. PCT/US2005/030392, filed Aug. 25, 2005, which claims the benefit of U.S. Provisional Application No. 60/604,621, filed Aug. 25, 2004.

BACKGROUND OF THE INVENTION

1. Field of the Invention

This invention relates to improvements and obtaining a higher quality in methods of using urethane sand cores while facilitating the production process thereof. Also this invention relates to improving the manufacturing process and replacing gun-drilling operations through the casting thus improving cycle during the manufacturing process.

2. Description of the Prior Art for Casting

Hitherto a variety of fabrication methods have been employed for metal, plastic and ceramic. Casting as a part of machining has been extensively used to fabricate metal. Injection molding is extensively used to fabricate mold plastic or ceramic. In these fabrication processes of the above materials, a metal (non-disintegrative) core or a disintegrative core is generally used to fabricate articles having a hollow section and/or an undercut section.

The former metal core is used only in cases that the core can be directly extracted from a mold or extracted upon deformation of the fabricated article. Accordingly, used of the metal core is limited to a certain narrow range. The latter disintegrative core is usually formed of sand and therefore provided with the following disadvantages: The sand core is difficult to be formed to a predetermined shape and tends to easily disintegrate thereby rendering difficult handling thereof. Additionally, the sand core cannot meet conflicting requirements of compression resistance during fabrication and disintegration characteristics after the fabrication.

In this regard, it has been recently proposed in the field of casting of metal, to employ a sand core which is coated at its surface with a particular coating material so as to improve the compression resistance during casting. The coated sand core is used in a casting mold. However, even employment of such a coated sand core has the following difficulties:

(1) A plurality of layers of the coating material are required to be formed on the sand core, thereby making difficult formation of the coating layers. This troublesome operation increases the number of steps of a production process while increasing time and cost for the production process.

(2) It is difficult to completely remove binder as components of the coating material and the sand core, after casting. The removal of the binder is usually accomplished by burning or heat-treating the sand of the core. The burning step increases the number of steps of the production process while increasing time and cost for the production process.

(3) The sand core is difficult to be formed while requiring a complicated equipment and considerable steps in the production process. Additionally, the sand core tends to easily disintegrate and therefore is difficult in handling thereby increasing the number of steps in the production process while degrading the yield of the casting.

(4) During casting, a complicated pressure regulation is required to prevent the sand core from disintegrating. Additionally it is difficult to completely disintegrate the sand core after the casting. The above requires a heat-treatment step for the sand core and a sand removing step, and an inspection step for removal of sand from the resultant casting (product), which increases the number of steps in the production process thus increasing time and cost for the production process.

(5) Penetration of molten metal into among sand particles of the sand core and penetration of components of the sand core into the casting (product) are made during the casting. These tend to produce small holes or cavities in the casting thereby degrading the yield and productivity of the casting (product).

(6) Complete removal of sand of the sand core is difficult after the casting, so that the sand remains attached on the casting (product) thereby causing wear and damage of the casting (product).

(7) It is difficult or substantially impossible to produce a complicated and/or large casting. This limits the application of casting methods using the sand core to a narrow range, thus providing troubles in designing and production of castings.

(8) Reuse of sand of the sand core is difficult because the sand core contains the coating materials and the binder which are difficult to be completely removed. For reuse of the sand of the sand core, further steps are required in the production process thereby increasing time and cost for the production process.

(9) The casting method using the sand core and gun-drill is usually accomplished with the following steps which require increased production time and cost: (a) Forming a sand core; (b) Coating the sand core; (c) Drying the sand core; (d) Forming a casting mold; (e) Pouring a molten metal to accomplish a casting operation: (f) Removing sand from a casting (product); (g) Heat-treating the sand on the casting (product); (h) Inspecting completion of sand removing; (I) Removing burr from the casting (product); (j) sending casting product to machining line; (k) drilling manufacturing holes to zero the casting (product); (l) drilling the necessary hole(s) into the casting (product); (m) Obtaining a complete casting (product).

It will be understood that the above-discussed problems in the casting method are encountered also in the molding methods (using the sand core) for casting iron and magnesium.

3. Description of the Prior Art for Replacing Gundrilling

Hitherto a variety of drilling methods have been employed for metal. Machining has been extensively used to fabricate metal. High speed machining tools in CNC Machines and standard carbide gundrills used in transfer line processes.

Regarding gun-drilling methods, a lot of money is needed in building a gun-drilling station and maintenance is needed in order to keep manufacturing processes going. Those methods are employed with the following difficulties:

(1) Coolant flow is difficult to regulate and causes gundrill breakage.

(2) Gundrills are used past their designated life and again gundrill breakage occurs.

(3) Stopping the line for changing the gundrill reduces cycle time in the manufacturing process.

(4) Maintenance and replacing parts of the gun-drilling station including the bushing, clamping, etc.

SUMMARY OF THE INVENTION

It is an object of the present invention to provide an improved method of fabricating an article by using a pre-tensioned sand core and an article produced thereby, which overcome drawbacks encountered in conventional similar method and article.

Another object of the present invention is to provide an improved method of fabricating an article by using a pre-tensioned sand core and an improved article produced thereby, by which high quality articles can be obtained while reducing the number of core breakage in a production process even if the article has a hollow shape.

An aspect of the present invention resides in a method of fabricating an article, comprising the following steps in the sequence set forth: placing a wire in a cold core box and clamping the ends of the wire, and said clamps puts tension on said wire; core box then closes and urethane core is formed around wire; core box separates, tension is released in wire, core is placed in compression, and thus core is formed.

A further aspect of the present invention resides in the core used in a fabrication mold for producing an article having at least one hollow section, the pre-tension sand core is then formed.

According to the principle of the present invention the following advantageous effects are obtained: (1) Using the pre-tension urethane sand core which does not easily disintegrate facilitates fabrication of a core in a casting mold thereby reducing core breakage and simplifying the manufacturing process and reducing the number of steps in a production while reducing time and cost in the production process. (2) The pre-tension urethane sand core does not tend to be easily broken even under rough handling and becomes easy in handling thereby facilitating the carrying and storing thereof. (3) The pre-tension urethane sand core reduces core breakage within the casting and therefore, no broken pieces from the core is penetrated into the casting (product), thereby, avoiding production of small holes or cavities in the casting (product). This prevents production of faulty products, thereby, improving the yield and the productivity of the casting (product), thus providing high quality castings (products). (4) The pre-tension urethane sand core makes easy formation of a hollow section of the casting (product). (5) This hollow section takes the place of drilling the hole into the casting (product). (6) Gun-drilling station is then omitted from the manufacturing process. (7) Maintenance of the gun-drilling station is also eliminated. Additionally, it is improved in strength and therefore, makes possible to produce the casting having a complete shape and full size regardless of the size, thus extending a casting application range. A wire is placed inside of a lower part of a core box (binder). Inside of the binder are clamps locking and holding each end of the wire in place. The upper half lowers onto the lower half of the binder and come together. As the binder closes the clamps on each end move away from each other and create tension on the wire until the clamps reach a designated distance. The sand mixed with resin are blown into the core box and then the catalyst is blown next hardening the sand and resin into place around the wire. When the catalyst is finished the upper and lower halves of the binder separate. As the two halves of the binder separate the clamps release the wire. When the wire is released form the clamps the wire starts to retract placing the core in compression The urethane sand core works well in compression, however, the wire retracts just a fraction of the distance and does not retract to the original position. This causes the wire to still be in tension, while the core is still in compression.

DESCRIPTION OF THE DRAWINGS

Other advantages of the present invention are readily appreciated as the same becomes better understood by reference to the following detailed description when considered in connection with the accompanying drawings wherein.

DETAILED DESCRIPTION OF THE INVENTION

According to a method of the invention, a pre-tensioned sand core is used to form a fabrication mold with using a sand core in smaller dimensions of width, at lower resin percentages, that has never been used before. The pre-tensioned sand core has been heretofore seemed to be impossible to be used as a core for the fabrication mold. The thus formed fabrication mold using the pre-tensioned core is employed for production of a casting (product). The pre-tensioned sand core is particularly suitable for fabricating an article having a cylindrical shape. The pre-tensioned sand core is required to have both a pressure resistance or non-disintegration characteristics during fabrication and a disintegration characteristics after the fabrication, the both characteristics conflicting with each other. Additionally, the pre-tensioned sand core is preferably required not to affect the product during fabrication, i.e., not to have fragile characteristics and avoid core breakage.

Figure 1:
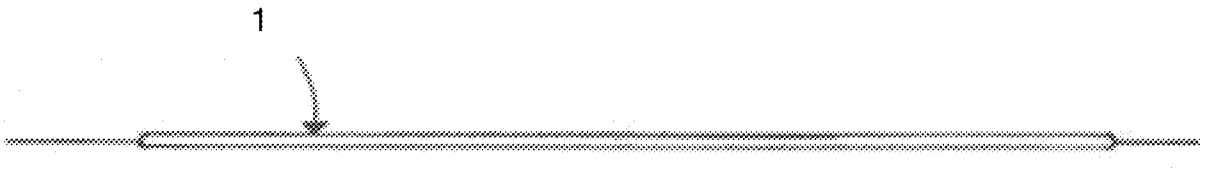
FIG. 1 is a depiction of the pre-tensioned sand core of the present invention.
Figure 2:
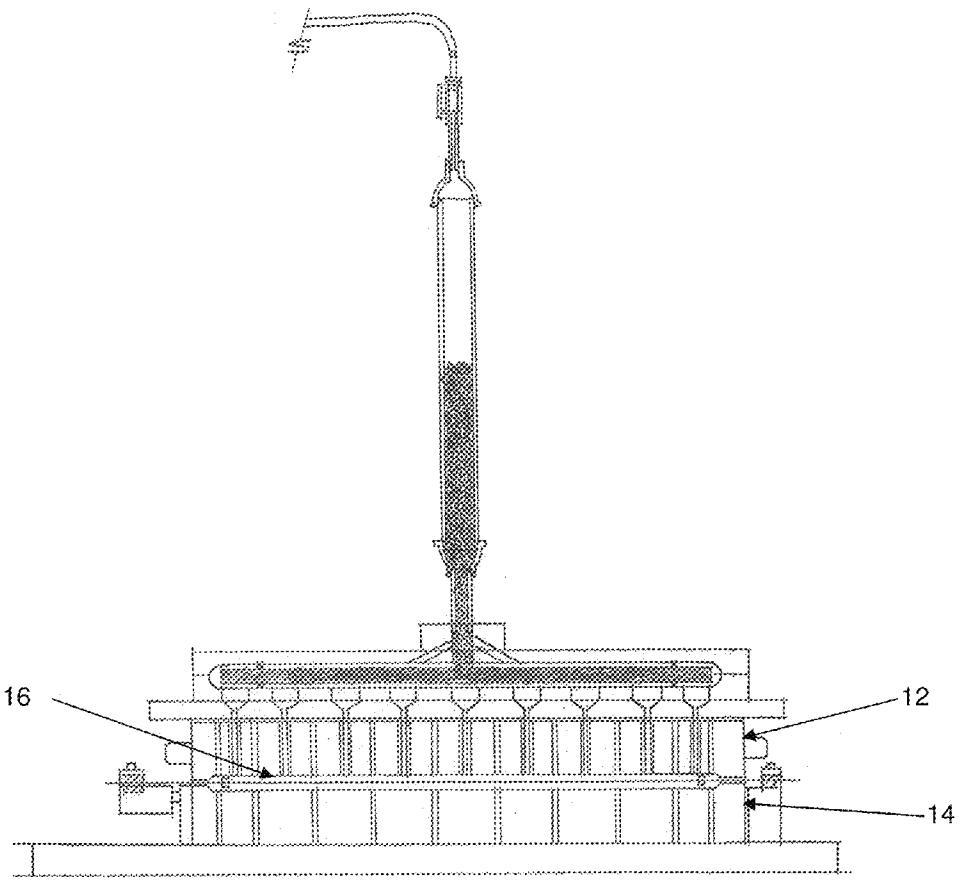
FIG. 2 is a cross-sectional view of the casting mold with an upper mold and lower mold.
Figure 3:
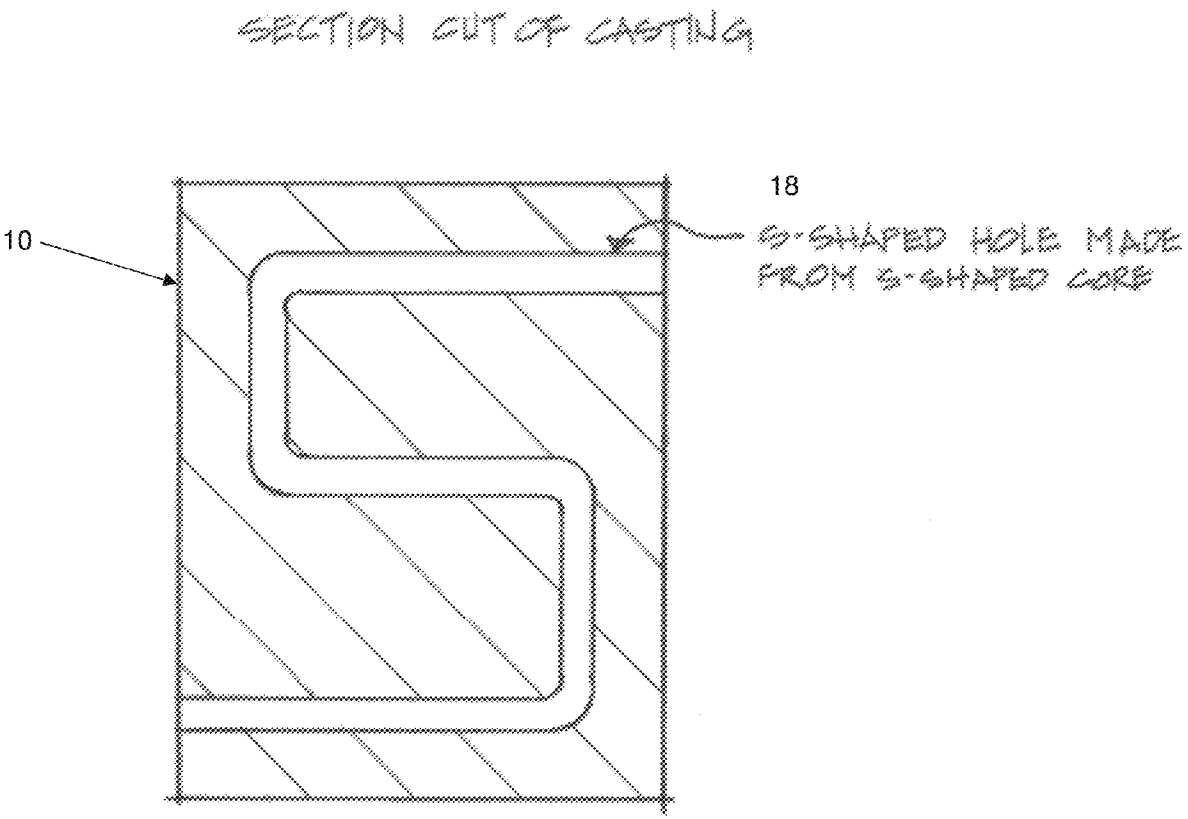
FIG. 3 is a cross-sectional view of a casting with a hole made from an S shape core.

The pre-tensioned sand core is preferably used in a casting mold to produce a casting 10 (product), and formed around cylindrical shapes. Accordingly, discussion of the first embodiment will be made on a method (casting method) of producing the casting by using a cylindrical shaped core (pre-tensioned sand core) under a gravity or low gravity casting process. In this embodiment, the pre-tensioned sand core 1 (shown in FIG. 1) is produced by a phenolic resin cold box binder method, to have a shape S 18 formed, as shown in FIG. 3. The pre-tensioned sand is fixedly disposed between an upper mold 12 and lower mold 14 thereby obtaining a casting mold. The pre-tensioned sand core has one or both ends securely mounted between the upper mold 12 and lower mold 14 shown in FIG. 2. A cavity 16 is formed between the upper mold and the lower mold and the pre-tensioned sand core. The shape of the cavity 16 corresponds of that of a casting (product) to produced under casting.

A molten metal of a metal material such as aluminum is poured under pressure into the cavity formed in the casting mold to obtain the casting (product) having a shape corresponding to that of the cavity. It will be understood that a variety of metals may be selected as the metal material of the molten metal so as to correspond to the material of the casting (product) to be produced.

The formed casting (product) is taken out by opening the casting mold thus completing a casting process. Thereafter, unnecessary portions such as burr are removed from the casting (product) thereby obtaining a resultant or complete casting which is required. Such a casting method using the pre-tensioned sand core effectively prevents core breakage during the casting process, thereby providing the casting (product) which is improved in appearance and functional qualities. Additionally, the casting method of this instance (according to the present invention) omits in the drilling manufacturing process and in the extensively used conventional casting method using a sand core. The conventional casting method usually includes the following steps: (1) Forming a sand core; (2) Drying the sand core; (3) Removing sand core from core box; (4) Transporting sand core to carousel and placing core into mold; (5) Pouring a molten metal to accomplish a casting operation; (6) Removing sand from a casting (product); (7) Heat-treating the sand on the casting (product); (8) Inspecting completion of sand removal; (9) Removing riser and burr from the casting (product); (10) Obtaining a complete casting (product); (11) Drilling hole into casting (product) with a gun-drill; (12) Maintenance of the drilling operation; (13) Replacing or re-sharpening gun-drill when dull; (14) Replacing gun-drill when gun-drill breaks slowing down production; (15) Maintaining coolant at the correct ratio of chemical composition. It will be understood that the above steps (11), (12), (13), (14), (15) can be omitted and made unnecessary in the casting method of this embodiment of the present invention. As discussed above, according to the casting method of this embodiment of the present invention, the casting (product) can be effectively obtained in high quality while greatly reducing the number of steps forming a hole and increasing the sand core's ability as compared with in the extensively used conventional casting method using the sand core.

The above mentioned pre-tensioned sand core maintains its initial shape during casting (from a time of pouring the molten metal and after solidification of the molten metal) thereby to contribute to formation of the casting (product) to be required. However, the pre-tensioned sand core surface is burned after casting under the action of remaining heat of the poured and solidifying molten metal, and removed manually or by heat treatment after the casting (product) is taken out from the casting mold so that there remains no residual material corresponding to the pre-tensioned sand core in the resultant casting (product). In the above casting method, the initial temperature (for example, about 660° C. in case of aluminum molten metal) of the poured molten metal is considerably lowered when the molten metal reaches the cavity of the casting mold, which may lead to the fact that the pre-tensioned sand core can maintain its initial shape even during the casting. Additionally, the pre-tensioned sand core maintain its initial shape under the action of temperature and latent heat of itself. When a predetermined time has lapsed to allow the molten metal to be solidified after completion of pouring the molten metal into the cavity of the casting mold, the pre-tensioned sand core is finally removed by heat-treatment or manually.

As discussed above, the pre-tensioned sand core is required to have both a pressure (compression) resistance or non-disintegration characteristics during the casting and disintegration characteristics after the casting which characteristics conflict with each other, and preferably required not to affect the casting (product) during casting, i.e., not to have a characteristics to generate a large amount of gas.

While the casting method of the present invention has been shown and described as being applied to metallic mold gravity casting, it will be understood that the principle of the present invention may be also applied to a sand mold gravity casting, a low pressure casting, a precision casting, and the like.

The resultant casting (product) can have a variety of cylindrical dimensions according to the casting method of the present invention.

It will be appreciated that modifications may be applied to the casting method in order to further improve the quality and the like of the resultant casting (product).

The following are advantageous effects of the casting method of the present invention.

(1) Using the pre-tensioned sand core which does not tend to easily disintegrate facilitates fabrication of a core in a casting mold thereby simplifying a casting equipment and reducing the number of steps in a production process while reducing time and cost required in the production process.

(2) The pre-tensioned sand core does not tend to be easily broken even under rough handling and becomes easy in handling, thereby facilitating the carrying and storing thereof. Additionally, it makes unnecessary a pressure-regulation during the casting, thus reducing the number of steps in a production process while reducing time and cost required in the production process.

(3) The pre-tensioned sand core makes easy formation of a hollow section of the casting (product). Additionally, it is improved in strength and therefore makes possible to produce the casting having a complete shape and full size regardless of the shape and the size, thus extending a casting application range.

(4) The pre-tensioned sand core is provided with both the pressure resistance or non-disintegration characteristics during casting and the disintegration characteristics after the casting which characteristics conflict with each other. Accordingly, penetration of the molten metal into the casting (product) can be prevented while making unnecessary the pressure control during the casting. Additionally, the complete disintegration and removal of the pre-tensioned sand core 1 can be facilitated after the casting.

Although the casting method has been shown and described in the present embodiment, it will be appreciated that the principle of the present embodiment may be applied to cast iron and magnesium which are high in quality while facilitating a production process therefore. Additionally, it will be appreciated that the pre-tensioned sand core of the present invention may be employed in a mold used for cast iron or magnesium casting (product), in which the pre-tensioned sand core can provide advantageous effects similar to those in the aluminum casting (product) while solving problems in conventional corresponding techniques.

Although the pre-tensioned sand core has been shown and being made in a cylindrical shape, it will be appreciated that the pre-tensioned sand core may be applied to any cold core box sand core with a structurally thin area on the core at a low resin percentage where the wire can add strength to the core by compression and be removed manually or through heat treatment. While the pre-tensioned sand core has been shown and described to replace gun-drilling in manufacturing for aluminum castings (products) the pre-tensioned sand core 1 can be applied to cast iron and magnesium which can satisfy the conflictive conditions (the pressure resistance during fabrication and the disintegration characteristics after fabrication).

In preferred embodiments, the invention is directed to methods as follows:

A metal wire is placed in an apparatus and each end of the metal wire is held into place by the clamp within the apparatus as the clamps pull each end of the metal wire and applies tension to the metal wire.

The apparatus holds the metal wire in tension within the yield point of the material of the metal wire.

The apparatus the metal wire is placed into is called a core box binder which said apparatus has a urethane sand mixture blown into the said apparatus forming around the metal wire.

The apparatus is a fixture designed for a urethane sand mixture blown into the core box which said mixture is blown under pressure with a designated amount of psi and the urethane sand mixture blown into the core box fixture forms into the shape of the core where said mixture is in the shape of the core and a liquid or gas catalyst is blown under pressure into the core box causing said mixture to be hardened in a very short period of time.

The metal wire placed into the core box is applied to cores that are in linear cylindrical shapes which said core is formed around the wire and hardened from the catalyst.

The metal wire placed into the core box is applied to cores that are in linear triangular cylindrical shapes which said core is formed around the wire and hardened from the catalyst.

The metal wire placed into the core box is applied to cores that are in linear rectangular cylindrical shapes which said core is formed around the wire and hardened from the catalyst.

The wire placed into the core box is applied to cores that are in a shapeless form and the wire is placed in a linear fashion, which said core is formed around the wire and hardened from the catalyst.

The clamps on each end of the wire is released and after which the entire core forming process the wire is still in tension at the designated pounds per square inch.

Once the clamps release the metal wire the metal wire will go back to the original shape before the metal wire was placed in tension.

The metal wire has protrusions or round shapes sitting perpendicular to the diameter of the metal wire where said round shapes are bonded to the metal wire to keep from moving and placement of said shapes are at each end of the core.

Once the clamps are released the shapes start to contract along with the metal wire and as said metal shapes contract compress the urethane sand core that is formed around the wire.

As the shapes contract said shapes are compressing the core that is formed around the wire which places the sand core in compression increasing the strength of the core and thereby the compression of the sand core does not exceed the ultimate strength of the core.

Any metal wire with tensile properties can be used as long as the wire used does not exceed the compressive ultimate strength of the sand core.

This procedure is used for cold core, hot core, thin shell core box process and puts the sand core in pretension application where this cylindrical sand core is used to replace gun-drilling applications to be placed in molds for aluminum, cast iron, magnesium and steel castings.

This procedure is used for cold core, hot core, thin shell core box process and puts the sand core in pre-tension application where this pre-tensioned sand core is used to create cavities in aluminum, cast iron, magnesium and steel castings.

Method of removing the pre-tensioned sand core can be done by either shaker for removing the sand then removing the wire itself, or heat treatment of the casting burning off the resin leaving the wire in place for easy removal, or removing the core with wire from casting after solidification of casting.

Wire within core allows core to bend without breaking. Core can bend until tensile strength on outside wall of core reaches ultimate strength and starts to flake and break.

Core can be formed in straight cylindrical form and then bent into an arc or curved shape when placed in mold. The curved shape will create a curved cylindrical cavity within the casting after solidification of casting. Cylindrical shape includes rectangular, triangular and round.

Wire of pre-tensioned sand core is placed through the entire length of core-box, bent within the core-box to create curved pre-tensioned sand cores. Protrusions sticking out of wire pressed against wall of core-box keep wire in designated placed inside of core-box cavity. Curved core is formed in core-box.

Wires can be placed in the core-box in zigzag shape. Cores are formed around wire in zigzag shape within core-box to form zigzag shaped cavities within casting. Similarly, the wire can be placed in the core-box in a chain shape.

A pre-tensioned wire applied in areas of cores that are very thin. Wire is placed in part of core-box cavity to pre-tension thin part of the core. Both ends are clamped. One end is in line with the core wire, the other end of the wire has a protrusion perpendicular to the wire. The perpendicular protrusion is clamped in the core-box to create the tension in the wire.

A pre-tensioned wire applied in areas of cores that are very thin. Wire is placed in part of core-box cavity to pre-tension thin part of the core. Both ends are clamped. Both ends of the wire has a protrusion perpendicular to the wire. The perpendicular protrusion is clamped in the core-box to create the tension in the wire.

A pre-tensioned wire applied in areas of cores that are very thin. Wire is placed in part of core-box cavity to pre-tension thin part of the core. Both ends are clamped. Both ends of the wire are in line with the core and are clamped.

Wire connected to another wire by use of a connector. The end of each wire connects to the connector to make the wire longer. The ends of each wire can be connected repeatedly to make an unlimited length.

A connector is a separate piece of the wire connecting two ends of two separate wires together. Connector is able to allow pre-tension to occur in newly shaped wire.

Wire with a clasped shaped ends. Ends of the wire shaped to connect one end of one wire to clasp to another end of another wire to form a longer wire. Able to allow pre-tension to occur in newly shaped wire.

The connector or the clasped shaped ends has the ability to turn the wire 180 degrees.

Wire connected together by smaller wires by use of a connector is placed into a core-box in a linear formation and placed in a pre-tensioned state.

Pre-tensioned composite core formed in a core-box with a wire connected together by smaller wires by use of a connector or clasped shaped ends. The connectors or clasped shaped ends are exposed and the same diameter of the core. The core bends at the connector to form the desired zigzag shape. The zigzag shaped composite core with connectors is placed into the casting to form a zigzag shaped cavity.

Small wires connected together by connectors or clasped shaped ends able to form a spiral shaped coil. The connectors or clasped shaped ends have little protrusions pressing against the wall of the core box. The wire is pre-tensioned before the core is formed in the core-box. The spiral shaped core is removed from the core-box and placed into a casting to form a spiral shaped coil cavity.

Figure 4A:
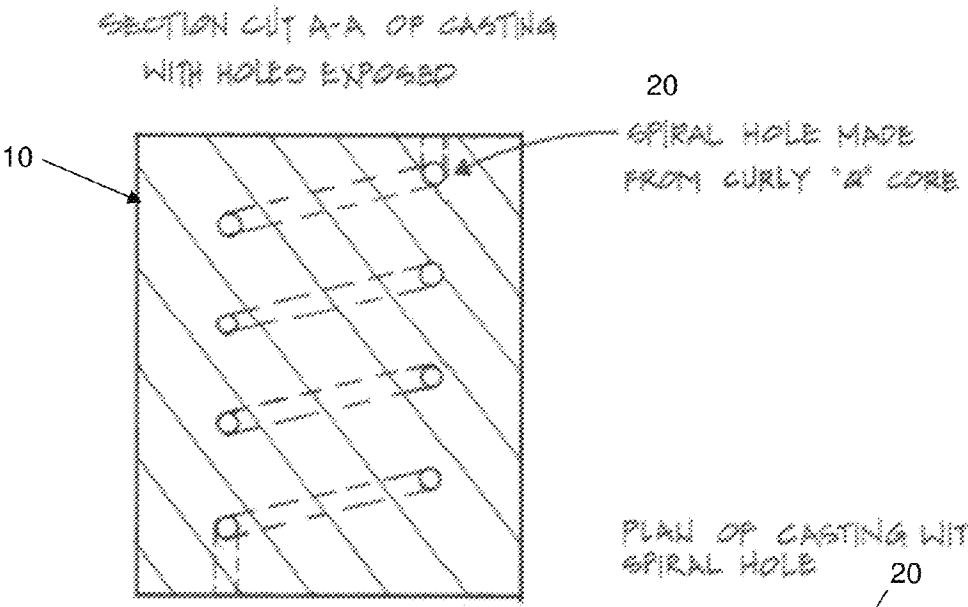
FIG. 4A is a cross-sectional view of spiral holes made from a curly q core and FIG. 4B is a plan of casting with a spiral hole.
Figure 4B:
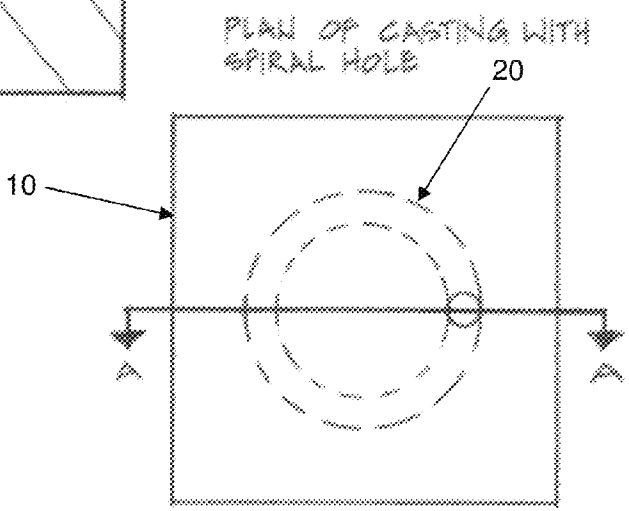

Small wires connected together by connectors or clasped shaped ends able to form a curly q shaped core, as shown in FIGS. 4A and 4B. The connectors or clasped shaped ends have little protrusions pressing against the wall of the core box. The wire is pre-tensioned before the core is formed in the core-box. The curly q shaped core is removed from the core-box and placed into a casting to form a curly q shaped cavity 20.

Small wires connected together by connectors or clasped shaped ends able to form a shapeless core. The connectors have little protrusions pressing against the wall of the core box. The wire is pre-tensioned before the core is formed in the core-box. The shapeless shaped core is removed from the core-box and placed into a casting to form a shapeless shaped cavity.

Protrusions sticking against wall of core-box have to be of a material that will not stick in casting when casting is formed around core to create cavity in casting for easy removal of core wire from casting.

Preferred embodiments of the invention are described in the following example. Other embodiments within the scope of the claims herein will be apparent to one skilled in the art from consideration of the specification or practice of the invention as disclosed herein. It is intended that the specification, together with the example, be considered exemplary only, with the scope and spirit of the invention being indicated by the claims which follow the example.

Example

Pretensioned Sand Core

Details of this Example is provided in Martin Zoldan, 2005, MS Thesis, Department of Mechanical Engineering, Wayne State University, and in U.S. Provisional Patent Application No. 60/604,621, filed Aug. 25, 2004, incorporated by reference herewith in its entirety.

Engine plants and machining companies in the automotive industry spend millions of dollars for machines and drills to drill holes in castings. The following method was created for an existing casting process and has the ability for more versatile applications. The method described in this paper can also be used for aluminum, cast iron, steel and magnesium for various casting methods. The casting methods this can be applied for are low gravity, high gravity, lost foam, and die casting processes. The sand core processes this can be applied to are: shell, no bake, hot box, and cold box processes. The proposed method replaces drilling holes in castings by pre-tensioning sand cores. The castings were cylinder heads and cylinder blocks used for engine assembly. Instead of machining the hole(s) in the manufacturing process, the hole(s) were made in the casting process. This proposed method is intended to be used for an existing application of replacing gun-drilling an oil passage through the cylinder head. Sand cores in the form of long cylindrical shapes, made in a cold core box process, are placed in compression that occurred by placing a wire into the core-box and pre-tensioning the wire. The sand core is then formed around the wire. The direct results of placing the sand cores in compression are increased in the core strength during handling, placing inside the mold, and the pouring process. Increasing the strength of the core will shorten the production cycle of making the head, and eliminate problems arisen from drilling the hole into the casting. The problems intended to be eliminated will be gun-drill breakage and porosity uncovered in the casting after drilling holes into the casting. The pre-tensioned sand core was set in a casting mold so as to form a cavity in the casting mold. The molten metal, for example, Aluminum, was poured to form the cavity inside the casting. The pre-tensioned sand core maintains its initial shape during casting. The two tests used on the actual product compressed the core by an instron machine and transverse tests with a jig by a tabletop instron machine. Calculations of thermal properties were made to determine performance for the core during the pouring process.

Details of this process follow.

The sand cores in a cold core box resin was made of sand and a resin. The cores were too fragile to be handled or removed from the core box. The cores needed to be strengthened without increasing the resin percentage. If the resin percentage is increased, the core was too hard and was not able to be removed through the heat treatment process or a shaker.

The sand core from a cold core box process had a property that had not been used before. The compressive property of the sand was similar to the compressive property of concrete. The core was compressed without interference to the core making process, thereby, improving the quality and performance of the cores.

The same principal of reinforcing concrete by placing steel rods in the concrete, which kept the concrete in compression and the steel in tension, was applied to the sand core from a cold core box process. By placing a wire into the core box and applying tension on the wire, the core is formed around the wire. The wire was allowed to retract towards its original shape, which placed the core in compression, therefore, the sand cores used the same principals of reinforced concrete.

Making the Equipment to Blow the Cores.

Placing a wire into a core and placing the composite core through a series of tests are part of the requirements in order to test the theory of pre-tensioning the sand core. Making a core 26" in length and a ½" diameter as the core forms around the wire, were the other parts of the requirements. The core had to be made under those conditions; there was no equipment available in order to make such a core. In order to make a core with a wire inside, a core-box able to hold a wire in place had to be designed and able to operate in safe conditions.

The entire core-box and piping system assembly is described as follows

The lower core-box was placed on a base plate, which serves as a level surface. The base plate is a 4"×1"×40" piece of steel. Mounted on the base plate are two clamps, a fixed clamp and the adjustable clamp. The clamps are spaced apart with enough room for clearance to place the lower core-box in-between the clamps. A 36" wire, with wooden dowels mounted on the wire was placed into the cavities of the lower core-box, which sat over each clamp and directly over each flat coarse file insert that was inserted in each clamp. The ¼"×1"×2" flat coarse file was placed over the wire sandwiching the wire. Then the ¼"×1"×2" flat steel plate was placed on top of the file. Two ¼-20 socket head screws were then placed through holes that were drilled into the ¼"×1"×2" file and plate for access to taps in each clamp. A 3/16" allen wrench was used to tighten the socket head screws. As the socket head screws tightened so did the ¼"×1"×2" and the No. 00 flat coarse files. The flat coarse files created a strong grip around the wire sandwiched in-between. A 5/16" allen wrench was used to move the adjustable clamps position and the scale measured the displacement of the clamp determining the amount of tension placed on the wire The upper core-box was grabbed, at each end, by the wooden handles. The guide-posts in the upper core-box were aligned and placed into the bushings in the lower core-box assembling into a single unit. The guide-posts placed into the bushings kept the upper and lower core-boxes together during operation.

The blow-plate was next. The blow-holes of the blow-plate were aligned and placed into the clearance holes at the top of the upper core-box.

The plumbing plates, which is connected to the piping system, was then connected to the blow-plate. There are two halves to the plumbing plates, an upper plumbing plate and a lower plumbing plate. Dowels on the blow-plate align the plumbing plates. A specially designed plumbing plate was placed on top of the upper core-box. A 2" nipple was screwed in at the top of the upper plumbing plate. On top of the nipple a 2" bell reducer was screwed on with a 2"×18" pipe screwed onto the bell reducer. The 2"×18" pipe, which was cut to size, was left open until the system was secured. At this point, pipe clamps were used to mount the plumbing plates-piping system onto the core-box assembly. This was done with the top of the pipe clamp placed on the top of the plumbing plates and the bottom of the pipe clamp placed under the level surface. The flat surface was under the core-box-piping system. This secured the core-box-piping system onto the flat surface to form a single unit. There were a total of four pipe clamps used to accomplish mounting the system together.

Now that the system was secured, the sand-resin composition needed to be mixed and prepared to pour into the open end of the 2"×18" pipe.

The sand-resin mixture was prepared in the following manner. 1000 g of silica sand was measured on a digital scale.

Resin at the desired percentage was calculated, which was then measured on the digital scale. If a 1.1-% of resin was desired, multiply 0.011 by 1000 g of sand. The product of this calculation was 11 g. Therefore 11 g of resin had to be measured. The resin was measured separately from the sand on the digital scale. A dropper was used to take resin from the container and dropped into a cup sitting on the digital scale until 11 g were reached. A flow agent was mixed into the resin to help the resin-sand mixture flow through the piping system. The amount of flow agent used was 0.04% of the resin amount. In this case the 11 g of resin was multiplied by 0.0004; the product of this equation was 0.0044 g. A dropper was used to drop the desired amount of the flow agent into the cup with the 11 g of resin. The sand was poured into a bowl, which was part of a kitchen tabletop mixer. Then the resin with the flow agent, at the desired percentages, was poured into the same bowl on top of the sand. Mixing the resin and sand together in the mixer created one mixture from the two compounds.

Figure 5:
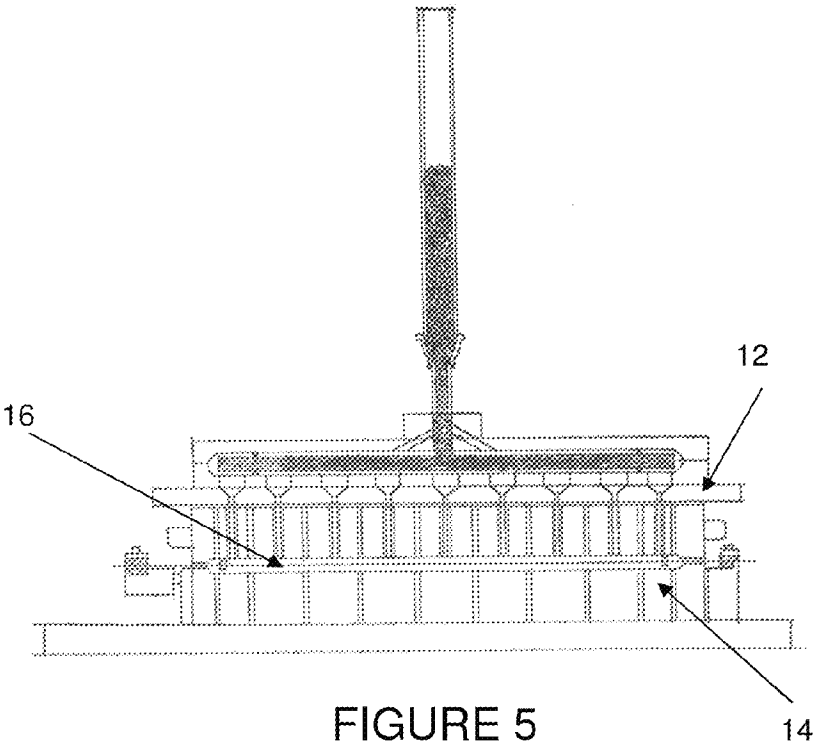
FIG. 5 is a depiction of the casting mold.

The completed mixture was poured into the end of the 2".times.18" pipe through a funnel (see FIG. 5). Once the mixture was poured in, the 2" bell reducer was screwed on. On top of the bell reducer was a ¾".times.2" nipple with a ¾" ball valve, a ¾" to ⅜" reducer and then a male schroder valve all screwed on top of each other in the order listed.

The female counterpart of the schroder valve was locked onto the male. The female was connected to a hose that connected to an air compressor. The entire system was ready and the valve of the ball valve was turned to the open position.

About 90 psi of air flowed through the hose to the 2"×18" pipe where the sand was. The force of the air blew the sand into the rest of the piping system. The sand flowed through the wooden cavity, then into the blow-holes of the blow-plate. The sand then flowed into the cavity of the core-box to form the desired shape of the sand core around the wire. Once the valve was opened for about 10 seconds and the sand was blown into the core-box, the valve was closed.

The piping system was first removed up to the 2"×18" pipe. This was needed to allow the pipe clamps to be removed. The piping system fully assembled was too bulky to be removed all at once, and needed to be removed in sections. Then the pipe clamps were removed. Next the blow-plate was lifted out of the upper core-box. The wooden blow-plate was placed over the upper core-box. The open end of the hose from the $CO_2$ tank was placed over the 1" hole on top of the wooden cavity. The $CO_2$ tank was opened and the $CO_2$ had a regulator set at 40 psi pumping $CO_2$ into the wooden cavity, which flowed into the core-box for 35 seconds. The 35-second time limit for the catalyst was enough to harden the sand-resin core.

The wooden blow-plate was lifted off the upper core-box. The 5/16" allen wrench was used to loosen the adjustable clamp and released the tension on the wire. Then the 3/16" allen wrench loosened the socket head screws which then loosened the ¼"×1"×2" plate and file on the top of the clamps of each end of the core-box. The socket head's screws were then removed from the taps. The upper core-box was then removed leaving the sand core exposed for removal from the cavity of the lower core-box with the sand formed around the wire. The product was now complete.

To summarize, the wire placed inside the core turned out to be beneficial in removing the core from the core-box. Removing the core without the wire inside caused the core to break. Placing the wire inside the core allowed the core to stay intact upon removal.

Material of Wire and Their Structural Properties.

Steel and Aluminum were considered for applying the pre-tension application to the cores. Steel was considered due to its ability to perform with concrete and its ability to perform better at the higher temperatures than other materials during the pouring process. Concrete and sand's compressive properties are the same, except sand is smaller. The scales of pressure and loads being applied will also be smaller than the pressure and loads used in reinforced concrete. The steel wire in sand gives a similar performance as steel wire in concrete. The castings were made of Aluminum and the wires used for testing will also be Aluminum. Aluminum can be re-melted to help reduce costs.

The yield point is the amount of pounds per square inch (psi) a wire can have before deformity is permanent. Using this information could help to determine how compression can improve the performance of the core. The yield point tells two important factors. The first factor is the amount of distance or elongation the wire can move. Knowing how far the wire can be stretched is important. Once it is known how far the wire can be stretched then it is known how far the wire will have to travel to go back into the wire's original position. If the amount of distance is more than the core can handle then there is a tendency to break the core while the core is forming in the core box. If the amount of distance is not enough to create a significant amount of compressive force on the core, then the wire should not be used. The second factor is the amount of psi. Different wires stretch with the same displacement but have a different psi. If the psi is too strong, the sand will be crushed during the blowing process of the formation of the sand core. If the psi is not strong enough, there will not be sufficient compressive force placed on the core.

The elastic stretch of the yield point for each material was determined by the use of the lower core-box. This type of testing to gather the information of the yield point was determined as follows.

The exact information for the specific wires used were not found in books and the manufacturers of the product did not use this material in this way. The wires are normally used as welding wires and the yield point for the material was used strictly in a welding scenario.

Placing the wire in the core-box and stretching the wire by the use of the core-box would give the yield point information on the performance of the wire. The core-box used for the testing of the yield point is the same core-box used for the making of the composite core.

The wire of each diameter was placed inside of the core-box and clamped on each end of the core-box by the fixed and adjustable clamps. The wire had a special caliber that would gage the wire as the adjustable clamp was moved stretching the wire. The caliber was attached to the core box in a stationary position. The caliber was placed on the end of the wire, on the adjustable clamp end, and measured the wire as the adjustable clamp was moved causing the wire to be stretched. Once the wire was moved to a certain amount, the wire was removed and then measured to see if the wire retracted back to the original length. Then the wire would be labeled and put aside. The process would be repeated until the wire of that diameter showed no elastic stretch from the same displacement. Once the same displacement was consistently shown from the testing, the displacement part of the yield point was found.

Each diameter wire of the steel showed a consistent performance for elastic stretch at ⅛" of displacement and retracted back to original length once removed from the core-box. The aluminum wire for each diameter showed a consistent performance also at ⅛" of displacement.

The lbf of the wires at yield point for each material was determined mathematically. The yield point for the steel was determined by using the formula with the modulus of elasticity for steel illustrated in Table 1. The yield-point for Aluminum and the amount of elasticity Aluminum can stretch is calculated in Table 2.

TABLE 1

[(Length in inches) (Load)] = Elastic Stretch
[(Metallic area) (Modulus of elasticity)]
[(Length in inches) (Metallic area) (psi of material)] = Elastic Stretch
[(Metallic area) (Modulus of elasticity)]
Psi of material = Elastic Stretch (Modulus of elasticity)
(Length in inches)
100694.44= [0.125"(29 × 106 psi)](1/36")

Metallic area for each wire diameter is:

$(1/8'')^2 \times 3.141593 = 0.012272\ in^2; (3/32'')^2 \times 3.141593 = 0.006903\ in^2; (1/16'')^2 \times 3.141593 = 0.003068\ in^2$ Load for each diameter at yield point is:

Diameter: (Area of wire)(Psi of material)=lbf of material

At ⅛": (0.012272 $in^2$)(100694.44 psi)=1235.72 lbf; At 3/32": (0.006903 $in^2$)(100694.44 psi)=695.094 lbf; At 1/16"; (0.003068 $in^2$) (100694.44 psi)=308.9 lbf The displacement for each diameter of the steel wire, at the yield point, is 0.125". The load for each diameter wire, at the yield point, is:

At ⅛"=1235.72 lbf; At 3/32"=695.094 lbf; At 1/16"=308.9 lbf

Table 2

The load for the aluminum was tested and determined under the similar conditions that the wire would be used. The ultimate strength of the wire was determined on an instron machine using clamps similar to the clamps used on the core box. From the point of ultimate strength the displacement and the load for that point was used to find the psi of the material and the modulus of elasticity of the material. Therefore the lbf of the material for the three diameters were able to be determined. The displacement for the yield point for the 1/16" diameter aluminum wire was too soft when clamped and too soft when the tap was formed on the wire. The displacement for the aluminum wire was found the same way the steel yield point was found for each of the diameters. The displacement for the yield point was determined as best as possible under these conditions, and came out to ⅛" of displacement for the yield point.

To determine the modulus of elasticity the wire was tested on the instron machine and the point of ultimate strength at 0.1956" at 299 lbf was found.

Psi of material=[(lbf of material)/(1/(Area of wire))]
24364.40678 psi=(299 lbf/0.01227")

Modulus of elasticity=[(Length in inches)(psi of material][(Elastic Stretch)]

4484246.647=[(36")(0.01227")]/(0.1956")

Psi of material=Elastic Stretch(Modulus of elasticity)
(Length in inches)

15570.30086=[0.125"(4.5×106 psi)]/(36")

Metallic area for each wire diameter is:

$(1/8'')^2 \times 3.141593 = 0.012272\ in^2; (3/32'')^2 \times 3.141593 = 0.006903\ in^2; (1/16'')^2 \times 3.141593 = 0.003068\ in^2$ Load for each diameter at yield point is:

Diameter: (Area of wire)(Psi of material)=lbf of material

At ⅛": (0.012272 $in^2$)(24364.40678 psi)=191.0787 lbf, At 3/32": (0.006903 $in^2$)(24364.40678 psi)=107.4818 lbf; At 1/16": (0.003068 in2) (24364.40678 psi)=47.77 lbf The displacement for each diameter of the steel wire, at the yield point, is 0.125". The load for each diameter wire, at the yield point, is:

At ⅛"=191.0787 lbf; At 3/32"=107.4818 lbf; At 1/16"=47.77 lbf

| | Steel (lbf at yield point) | Aluminum (lbf at yield point) |
|---|---|---|
| ⅛" | 1235.72 lbf | 191.0787 lbf |
| 3/32" | 695.094 lbf | 107.4818 lbf |
| 1/16" | 308.9 lbf | 47.77 lbf |

As shown above, the load for the yield point for the steel shows that the steel is about 6 times stronger than the yield point for the aluminum.

Compression testing on urethane sand cores helped determine better tolerances for the wires used. Compression testing is discussed below.

Compression and Tension Data of Cores at Different Resin Percentages.

The wires were pre-tensioned when placed in the core creating a compressive condition on the sand core. The compression data showed tolerances of performance on the cores at different resin percentages. The data from the compression tests showed ultimate compressive strength. The ultimate compressive strength corresponded to both ultimate displacement and psi for each resin percentage.

The different resin percentages were used for the following reasons:

1. Regardless of how many checks were implemented, variations in the process occurred. The different resin percentages gave an idea of the type of problems that resulted from those variations.

2. Determining the performance of the resin percentages when the percentage became lower. There was a possibility of using a lower resin percentage and reducing the cost of resin.

Compression samples for ECOLOTEC® (Ecolotec, Inc.) sand cores were made as follows. The sand resin composition was mixed and poured into a 2" diameter by 3" long pipe. A reducer with valve was screwed onto the reducer. The hose connected to the air compressor was attached to the valve. The 2" diameter by 3" pipe connects to a ¾" nipple which is screwed in to a ¾" flange. The ¾" flange is screwed into the top piece of wood. The top piece of wood is one of three pieces of wood used to keep the 2" diameter.times.2" pipe together as a single unit. The 2" diameter.times.2" long plastic pipe was used as a core-box to create the samples. The other two pieces of wood are on the bottom. Two bolts at 6.5" in length ¼" diameter are on each side keeping the 3 pieces of wood and 2" diameter pipe sandwiched together. The two pieces on the bottom are screwed together. There is a 2" diameter ¼" thick piece of wood with holes punched through to be used as vents on the top of the two bottom pieces. Between the two pieces is a screen cut to size to fit between the two pieces of wood. The bottom face of the bottom piece of wood has holes also punched through to venting, which started on the top piece. Once the valve is turned to the open position the sand resin composition blows right into the 2" diameter.times.2" pipe.

The sand resin composition fills up the 2" diameter×2" pipe displacing the air out of the 2" diameter×2" pipe through the vents created in the two lower wooden pieces. Once the sand resin composition is blown into the core-box, the piping system is removed and the CO2 catalyst is blown into the 2" diameter×2" pipe for 30 seconds to solidify the sand resin composition into the sample core. The sample core was removed from the core-box pipe. This procedure was repeated for different resin percentages.

Each of the samples were taken to an instron machine for testing.

| Specimen of 2.4% Resin | Displacement | Deflection |
|---|---|---|
| Yield Point | 0.02679" | 268.55469 lbs |
| Point at Ultimate Strength | 0.04012" | 566.40625 lbs |

The data obtained from the instron machine of the sample core at 2.4% resin was used to obtain the yield point and point of ultimate strength for the 26" long core at ½" diameter. The following calculations determine how much a 26" long core could handle being compressed.

[(Length in inches)(Load)]=Elastic Stretch

[(Metallic area)(Modulus of elasticity)]

2"*268.555=6379.1951

(pi)(1)(0.02679")

2"*566.40625=8984.056354

(pi)(1)(0.04012")

Yield Point

Psi of material=lbf of material (Psi of material)*(Area of wire)=lbf of material Area of wire 85.48371148=268.555→(85.48371148)*(0.19634954)=16.78469 3.141593

Point of Ultimate Strength

Psi of material=lbf of material (Psi of material)*(Area of wire)=lbf of material Area of wire 180.292709=566.40625→(180.292709)*(0.19634954)=35.40039 3.141593

[(Length in inches)(Load)]=Elastic Stretch

[(Metallic area)(Modulus of elasticity)]

26"*16.78469=0.34827

(pi)(0.0625)(6379.1951)

26"*35.40039=0.52156

(pi)(0.0625)(8984.056354)

| Calculation of 26" long Core @ 2.4% Resin | Displacement | Deflection |
|---|---|---|
| Yield Point | 0.34827" | 16.78469 lbs |
| Point at Ultimate Strength | 0.52156" | 35.40039 lbs |

The data on these tests helped clarify under what parameters a wire could be used for compressing the sand in a tensile condition. Comparing the displacement of the core at the point of Ultimate Strength shows that the yield point of the wires is within the displacement of Ultimate Strength for the core. The point of Ultimate Strength is also the fracture point for the core. The table below lists the loads for the yield points, by diameter for the steel and the aluminum. All displacement at the yield point for both materials are at ⅛".

| diameter | Steel (lbf at yield point) | Aluminum (lbf at yield point) |
|---|---|---|
| ⅛" | 1235.72 lbf | 191.0787 lbf |
| 3/32" | 695.094 lbf | 107.4818 lbf |
| 1/16" | 308.9 lbf | 47.77 lbf |

| Calculation of 26" long Core @ 2.4% Resin | Displacement | Deflection |
|---|---|---|
| Yield Point | 0.34827" | 16.78469 lbs |
| Point at Ultimate Strength | 0.52156" | 35.40039 lbs |

Looking at the yield point for the 1/16" Aluminum Wire and comparing that to the point of ultimate strength for the 26" long core shows that the 1/16" long wire is almost at the same amount of strength as the core.

Regardless of the sand core process used, a similar process of testing cores could be used to help establish parameters for each type of sand core process. More tests on cores made in a core-box for the urethane sand cores, helped give more accurate parameters. The calculations performed are based on cores without the wires inside of the cores. This data clearly shows how fragile a core at 26" in length at 0.5" in diameter would be. Compression testing of a core with a wire inside of the core would give more information on the composite cores strength in compressive conditions.

Transverse Data.

The intent of the transverse test is to explore the inherent compressive property in the core with the purpose of proving the improvement in the strength of the core with or without a wire. The core needed to be strong enough for removal from the core box, handling from the core box and into the mold, and the pouring process of the molten metal into the mold. Another important attribute to this application is the ability to make thin and long cores and validating thin and long cores can be made without hindering the casting and core making process. The transverse testing of the cores would determine if adding the wire to the core would enhance the strength of the core through the compressive property of the core.

Figure 6:
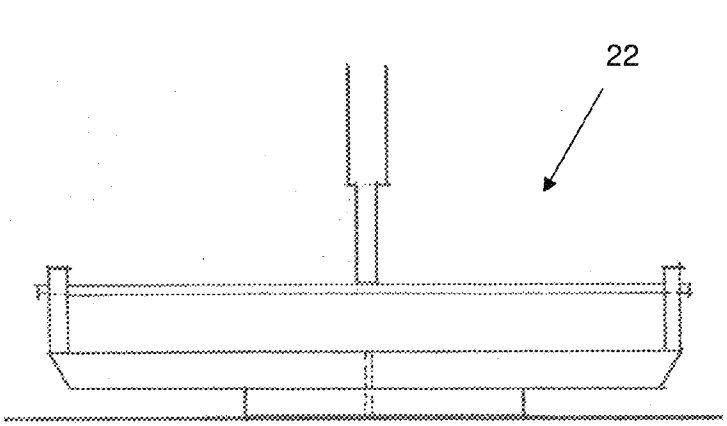
FIG. 6 is a depiction of a jig.

A tabletop Instron machine was used for the testing. Two makeshift jigs were made to attach to the Instron for a three point bending test. Jig 1 and jig 2 (an example of a jig is shown in FIG. 6 at 22) were made with the same material and the same dimensions, except for the length. Jig 1 was made from a 1"×1"×11" rectangular aluminum tube and was used for testing the sand cores without the wire placed in the core.

Jig 2 was made from a 1"×1"×22" rectangular aluminum tube and was used for testing the pre-tensioned composite sand cores. Jig 1 and jig 2 were attached to the Instron base with ½-20 screw. The specimens tested on jigs 1 and 2 were not fixed ends for each test.

Three cores without the wire were placed on jig 1 and the Instron machine measured load, and deflection. Cores with the wire were placed on jig 2 and the Instron machine measured load, and deflection. The performance of the cores with the wire, compared to the performance of the ores without the wire, indicated in what way improvement of performance took place and the mount of improvement. A third set of testing was done on each diameter wire. One wire at a time, representing each diameter of the wire in the core, was placed on jig 2. Each wire placed on jig 2 and the Instron machine measured load, and deflection.

Three cores without the wire were tested on the Instron machine. A wireless 26" core was too fragile to stay intact from the removal of the core-box and be tested on the Instron machine. From the broken pieces three were recovered at different lengths to be used for the testing on the Instron. The longest length wireless core was at 15", the second at 11", and the shortest at 6". The three wireless core graphs were placed on each of the six charts for comparison with each composite pre-tensioned core. The table below will indicate what is in the charts regarding the 6", 11", and 15" wireless cores in summary form. The 6" and 11" wireless cores reached their Ultimate Load at 1 pound, and the 15" wireless core reached its Ultimate Load at 0.733 lbs. The 6" and 11" Ultimate Loads were higher than the 15" wireless core. The 6" and 11" have equal loads of deflection, however, the 6" has a longer displacement than the 11" wireless core.

| Specimen | Displacement | Deflection |
|---|---|---|
| 15" Wireless Core (point at Ultimate Strength) | 0.0494" | 0.733 lbs |
| 11" Wireless Core (point at Ultimate Strength) | 0.0420" | 1 lbs |
| 6" Wireless Core (point at Ultimate Strength) | 0.0455" | 1 lbs |

This is logical since the 6" core is shorter and able to offer more resistance at the same diameter than the 11" and 15" wireless cores.

Due to the significance in performance of the composite cores on the Instron test, all six scenarios of cores of different material wire and different diameter wire were tested on the Instron Machine and analyzed in this chapter. The six charts will show that the composite cores displayed a different performance with the wires placed inside the cores, compared to the wireless cores. Displacement for the composite cores exceeded the wireless cores displacement. The composite cores tested on the Instron machine did not break, except for the ⅛" steel diameter wire. The composite cores bent and continued to bend as more force was placed onto the cores. As each core bent, the upper surface of the core would be in compression, and the bottom surface of the core would be in tension. The surface of the core on the compressive side bent until the compressive surface started to flake. The point before the upper surface started flaking; the composite core had reached a yield point. The tensile side stayed intact. The jig allowed for 1½" of displacement, and the composite cores tested on the Instron reached the 1½" clearance, except for the ⅛" steel diameter. The ⅛" steel diameter broke before reaching the maximum 1½" clearance jig 2 allowed. The ⅛" steel diameter wire offered more resistance than the core surrounding the wire could handle. The other composite cores did not break and bent all the way to jig 2's 1½" clearance. Once the Instron machine finished testing, the Instron retracted and the core would be released. Upon release from the Instron machine the cores that did not break retracted to their original starting position. All cores retracted to their original position and shape except for one. The 1/16" Aluminum wire composite core, shown in chart 1, stayed bent and did not retract into position. The wire bent due to the softness and thinness of the 1/16" diameter wire, however the core and the wire together as a composite kept the composite core bent. The core did not retract to the original position once the test was completed. The ⅛" diameter wire offered so much resistance against the pressure from the Instron; this caused the area of core between the Instron and the wire to break exposing the wire underneath the core.

Each wire representative of the six scenarios were placed on jig 2 and tested on the Instron. As was done with the other specimens, the wires were placed on the jig and the ends were not fixed. Each of the wire performance was a linear line with a slight slope. Since the ends were not fixed the Instron machine moved the wires with little resistance.

d) Comparison of the Composite Core and the Composite Cores Component Parts

Figure 7:
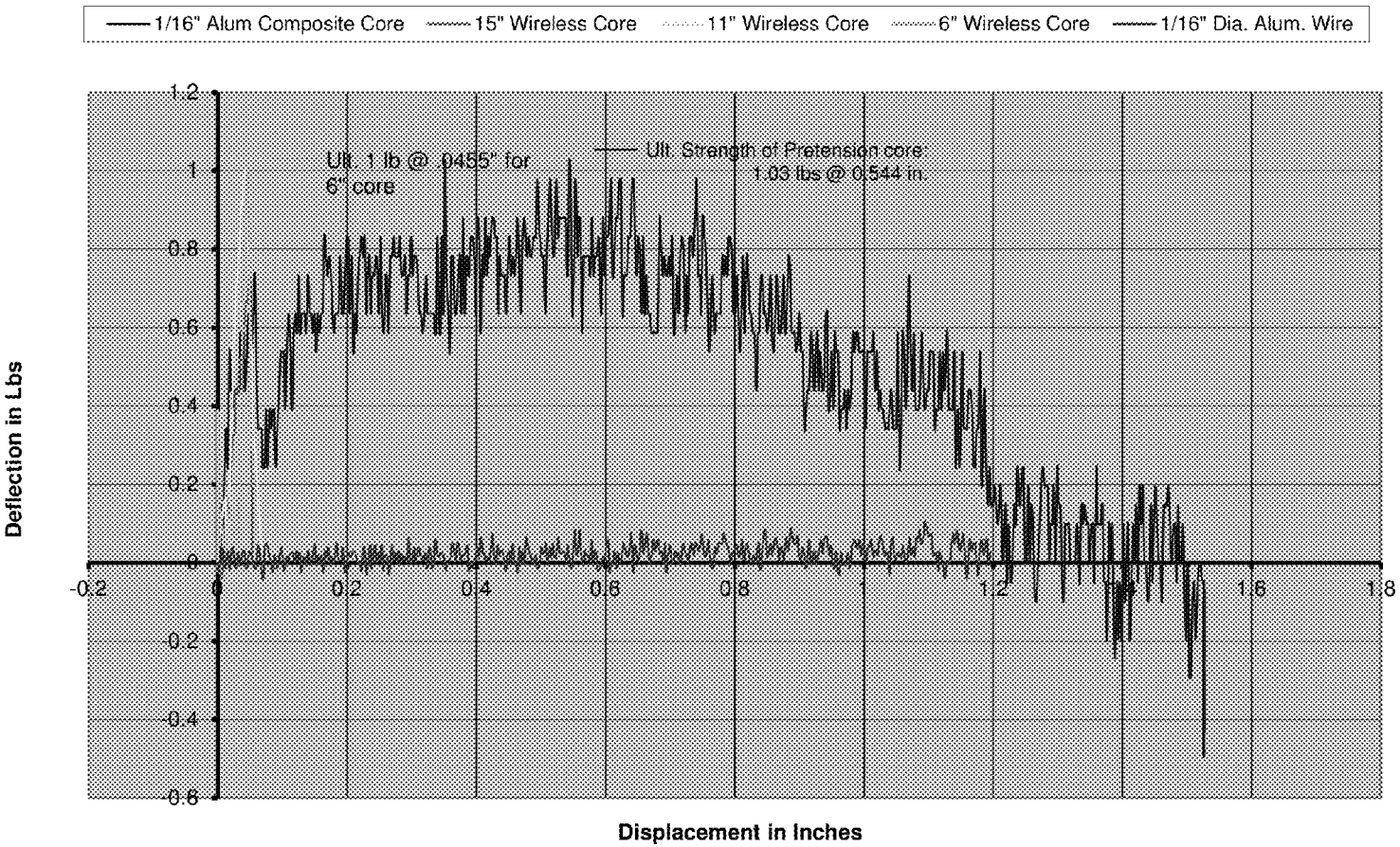
FIG. 7 is a graph of 1/16" aluminum wire core deflection versus displacement.

Chart 1 (shown in FIG. 7): 1/16" Aluminum Wire Core

Table VI.1a and b will indicate what is in the charts regarding the 6", 11", and 15" wireless cores, the 1/16" aluminum composite core, and the 1/16" diameter aluminum wire, in summary form.

TABLE VI.1a (Comparing Wireless Cores to Composite Core)

| Specimen | Displacement | Deflection |
|---|---|---|
| 15" Wireless Core (point at Ultimate Strength) | 0.0494" | 0.733 lbs |
| 11" Wireless Core (point at Ultimate Strength) | 0.0420" | 1 lbs |
| 6" Wireless Core (point at Ultimate Strength) | 0.0455" | 1 lbs |
| 1/16" Composite Core comparing displacement | 0.0450" | 0.538 lbs |
| 1/16" Composite Core at Ultimate Strength (comparing deflection) | 0.544" | 1.03 lbs |

TABLE VI.1b (Comparing Wire to Composite Core)

| Specimen | Displacement | Deflection |
|---|---|---|
| 1/16" Diameter Wire | 1.2" | 0.0587 lbs |
| 1/16" Composite Core comparing displacement | 1.2" | 0.44 lbs |

TABLE VI.1b-continued (Comparing Wire to Composite Core)

| Specimen | Displacement | Deflection |
|---|---|---|

Looking at the chart and comparing the graphs of the wireless cores to the graph of the composite core, the first behavior noticed was the difference in displacement with respect to the Load. The 1/16" Aluminum wire Composite Core reached the same Ultimate Load as the 6" and 11" long wireless cores. The 1/16" composite core exceeded the 6", 11", and 15", wireless cores in terms of displacement. The 6" wireless core reached a displacement of 0.0455" at the 6" wireless core's Ultimate Point The 1/16" composite core's displacement at the Ultimate Point is 0.544". This data shows the 1/16" composite core reached the same Ultimate Strength of the wireless core, however, the composite core bent out of shape until the Ultimate Load was reached. The 1/16" composite core does not have the rigidity needed during the pouring process. The other behavior the 1/16" composite core exhibited occurred when the core reached 1.19 inches at 0.44 lbs., the core cracked through the 1/2" diameter thickness of the core.

The 1.19" at 0.44 lbs. point is the fracture point for the 1/16" composite core. The 1/16" composite core did not break exposing the core, the only composite core to break in that manner was the 1/8" steel wire, due to the rigidity of the 1/8" wire. The 1/16" composite core cracked due to the thinness and softness of the 1/16" wire. The 1/8" wire coupled with the core was too rigid and broke the core surrounding the area. The 1/16" aluminum wire kept the core together, however, and this caused the core to crack instead of break. The 1/16" composite core fracture point is a different point than the point of Ultimate Strength. The fracture point and the point of Ultimate Strength of the wireless cores are the same point. Once the fracture point is reached, the wireless cores break.

The 1/16" Aluminum Wire was placed on the Instron Machine and the data collected shows the 1/16" wire in a linear line with a slight slope. The 1/16" wire reached a maximum displacement of 1.2" at 0.0587 lbs., which is a 1:20 slope. This is a significant improvement in comparison in regards to the composite core, which reached 0.44 lbs. at the same displacement as the wire. That means the composite core is 7.5 times stronger than the wire at the same displacement.

The data shows the composite core is able to bend farther than the wireless cores. The data also shows the composite core is stronger than the 1/16" Aluminum wire. One avenue that needs further analysis is the performance of the 1/16" composite core with fixed ends. The composite core, with fixed ends, is expected to significantly reduce the amount of deflection from the 1/16" composite core. How much reduction in deflection is difficult to say, however, the five other charts will show the larger the diameter of the wire the stronger the resistance against deflection for the composite core as a whole.

Table VI.2a and b will indicate what is in the charts regarding the 6", 11", and 15" wireless cores, the 1/16" steel composite core, and the 1/16" diameter steel wire, in summary form.

TABLE VI.2a (Comparing Wireless Cores to Composite Core)

| Specimen | Displacement | Deflection |
|---|---|---|
| 15" Wireless Core (Ultimate Strength) | 0.0494" | 0.733 lbs |
| 11" Wireless Core (Ultimate Strength) | 0.0420" | 1 lbs |
| 6" Wireless Core (Ultimate Strength) | 0.0455" | 1 lbs |

TABLE VI.2a-continued (Comparing Wireless Cores to Composite Core)

| Specimen | Displacement | Deflection |
|---|---|---|
| 1/16" Composite Core comparing displacement | 0.0420" | 0.489 lbs |
| 1/16" Composite Core at Ultimate Strength (comparing deflection) | 0.146" | 1.12 lbs |

TABLE VI.2b (Comparing Wire to Composite Core)

| Specimen | Displacement | Deflection |
|---|---|---|
| 1/16" Diameter Wire | 1.37" | 1.37 lbs |
| 1/16" Composite Core comparing displacement | 1.37" | 2.5 lbs |

Figure 8:
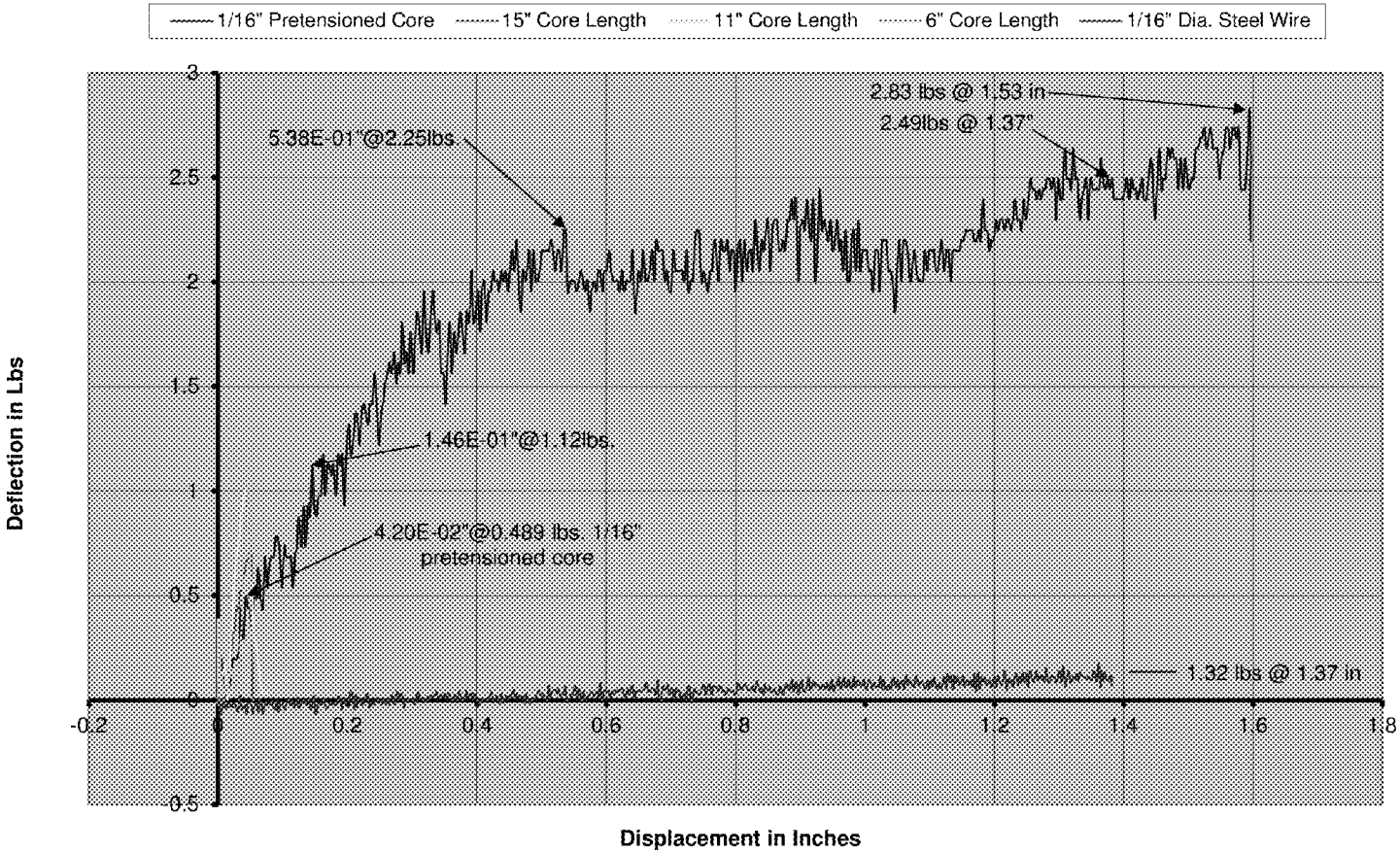
FIG. 8 is a graph of 1/16" steel wire core deflection versus displacement.

Chart 2 (shown in FIG. 8) has a significant improvement from the performance of the previous chart of the 1/16" Aluminum Wire Composite Core. The core still bends, in a similar performance as in chart 1, with the exception of the 1/16" steel composite core not breaking. The point of Ultimate Strength the 1/16" steel composite core reached is 2.83 lbs at 1.53". The 1.53" is the 1.5" maximum clearance on the jig. There is a steady increase in strength until the 1/16" Steel composite core reaches 2.25 lbs at 0.538". The 6" wireless core reached an Ultimate Strength of 0.0455" at 11b before fracturing, while the 1/16" Steel Composite Core reached 0.489 lbs at 0.0420" and did not reach 1.12 lbs until 0.146" of displacement. The 1/16" steel composite core did not fracture when the core bent until the 1.5" displacement limit of clearance on the jig was reached. The 1/16" steel wire has a slope of 0.964. The highest the wire reached was at 1.37 inches at 1.37 lbs, comparing that to the 1/16" composite core, at 1.37 inches the core reached 2.5 lbs.

Figure 9:
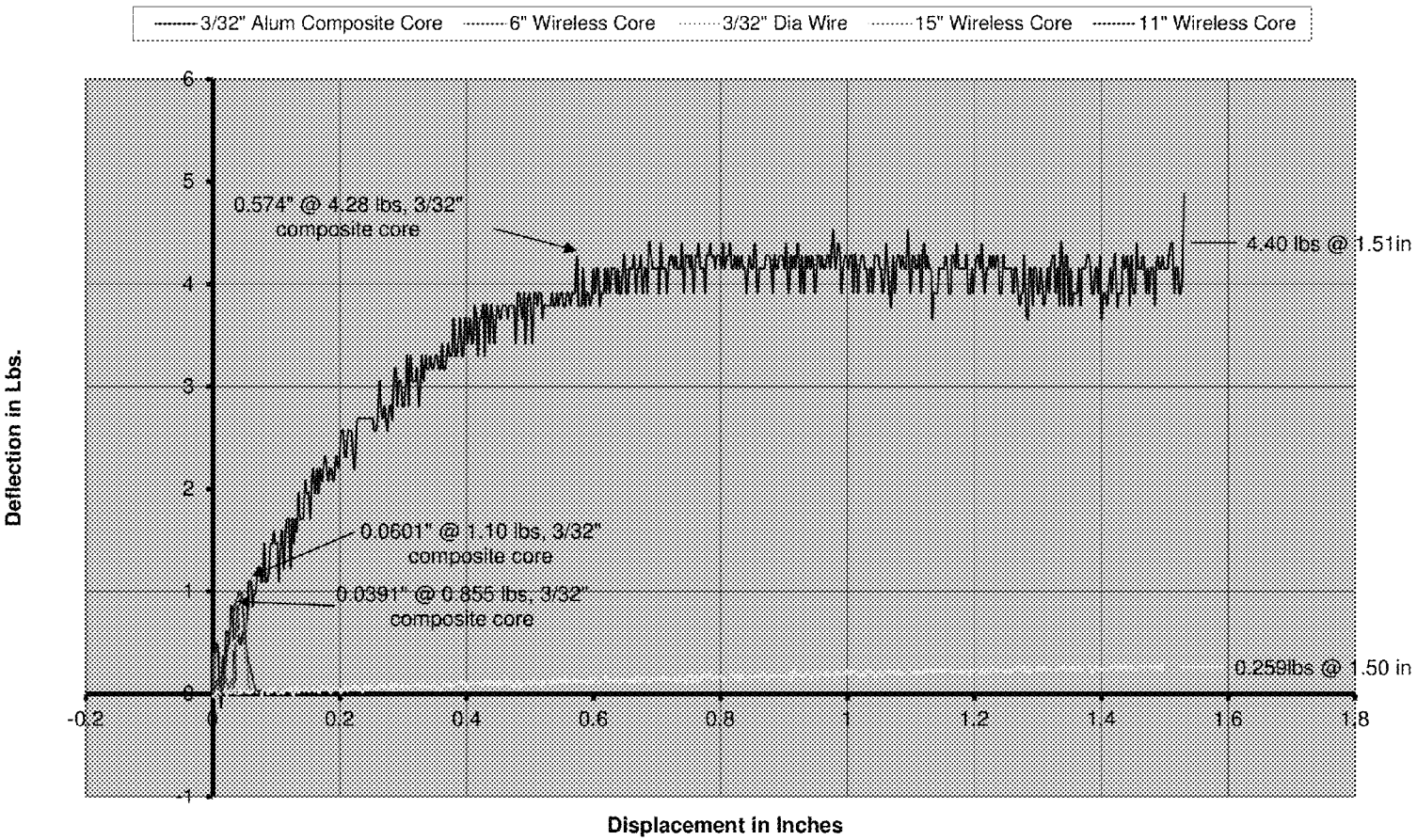
FIG. 9 is a graph of 3/32" aluminum wire core deflection versus displacement.

Table VI.3a and b will indicate what is in the charts regarding the 6", 11", and 15" wireless cores, the 3/32" aluminum composite core, and the 3/32" diameter aluminum wire (shown in chart 3 in FIG. 9), in summary form.

TABLE VI.3a (Comparing Wireless Cores to Composite Core)

| Specimen | Displacement | Deflection |
|---|---|---|
| 15" Wireless Core (Ultimate Strength) | 0.0494" | 0.733 lbs |
| 11" Wireless Core (Ultimate Strength) | 0.0420" | 1 lbs |
| 6" Wireless Core (Ultimate Strength) | 0.0455" | 1 lbs |
| 3/32" Composite Core comparing displacement | 0.0391" | 0.855 lbs |
| 3/32" Composite Core (comparing deflection) | 0.0601" | 1.10 lbs |
| 3/32" Diameter Wire | 1.5" | 0.259 lbs |
| 3/32" Composite Core comparing displacement (Ultimate Strength) | 1.51" | 4.40 lbs |

The ultimate strength of the composite core reached a point of 1.51" at 4.40 lbs. This is almost doubled compared to the Ultimate Strength of the 1/16" Steel composite core. The composite core is far stronger than the wire, which was tested by itself. The wire tested reached a max. of 0.259 lbs. @ 1.50 in.

Table VI.4a and b indicates contents in the charts regarding the 6", 11", and 15" wireless cores, the 3/32" steel composite core, and the 3/32" diameter steel wire, in summary form.

TABLE VI.4a (Comparing Wireless Cores to Composite Core)

| Specimen | Displacement | Deflection |
|---|---|---|
| 15" Wireless Core (Ultimate Strength) | 0.0494" | 0.733 lbs |
| 11" Wireless Core (Ultimate Strength) | 0.0420" | 1 lbs |
| 6" Wireless Core (Ultimate Strength) | 0.0455" | 1 lbs |
| 3/32" Composite Core comparing displacement | 0.0455" | 0.855 lbs |
| 3/32" Composite Core (comparing deflection) | 0.052" | 1 lbs |

TABLE VI.4b (Comparing Wire to Composite Core)

| Specimen | Displacement | Deflection |
|---|---|---|
| 3/32" Diameter Wire | 1.5" | 0.777 lbs |
| 3/32" Composite Core comparing displacement (Ultimate Strength) | 1.54" | 10.9 lbs |

The ultimate strength of the 3/32" steel composite core reached a point of 1.54" at 10.9 lbs. This is more than doubled compared to the 3/32" aluminum composite core. The composite core reached 1 lbs at 0.052 inches, where the 11" wireless core reached 1 lb at 0.042 inches, this point is also the ultimate strength for the 11" wireless core. The wire tested reached a maximum of 0.777 lbs. @ 1.50 in.

Figure 11:
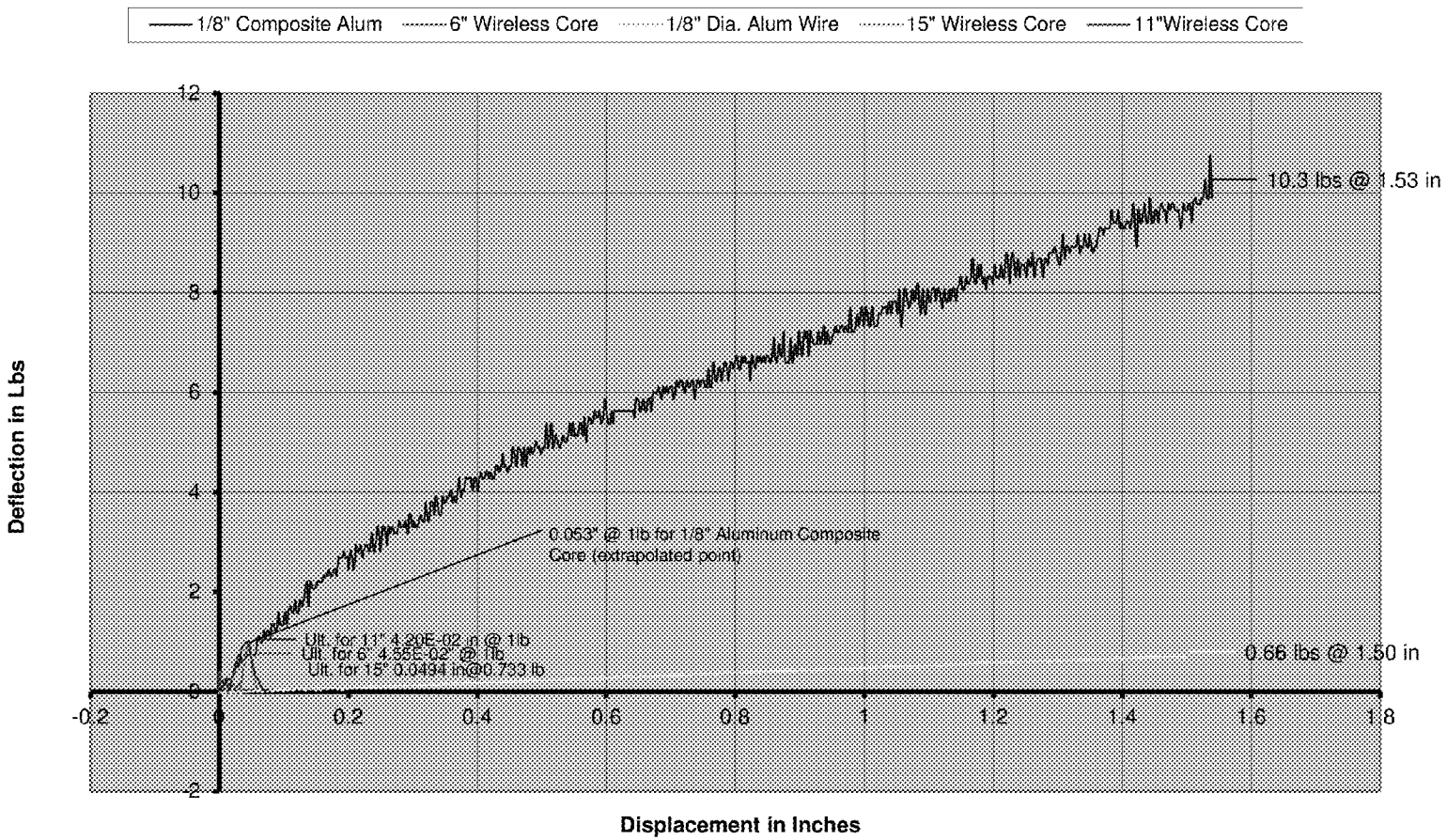
FIG. 11 is a graph of 1/8" aluminum wire core deflection versus displacement.

Table VI.5a and b indicates what is in the charts regarding the 6", 11", and 15" wireless cores, the 1/8" aluminum composite core, and the 1/8" diameter aluminum wire (shown in chart 5 in FIG. 11), in summary form.

TABLE VI.5a (Comparing Wireless Cores to Composite Core)

| Specimen | Displacement | Deflection |
|---|---|---|
| 15" Wireless Core (Ultimate Strength) | 0.0494" | 0.733 lbs |
| 11" Wireless Core (Ultimate Strength) | 0.0420" | 1 lbs |
| 6" Wireless Core (Ultimate Strength) | 0.0455" | 1 lbs |
| 1/8" Composite Core comparing displacement | 0.0450" | 0.733 lbs |
| 1/8" Composite Core at Ultimate Strength (comparing deflection) | 0.053" | 1 lbs |

TABLE VI.5b (Comparing Wire to Composite Core)

| Specimen | Displacement | Deflection |
|---|---|---|
| 1/8" Diameter Wire | 1.5" | 0.66 lbs |
| 1/8" Composite Core comparing displacement (Ultimate Strength) | 1.53" | 10.3 lbs |

Figure 10:
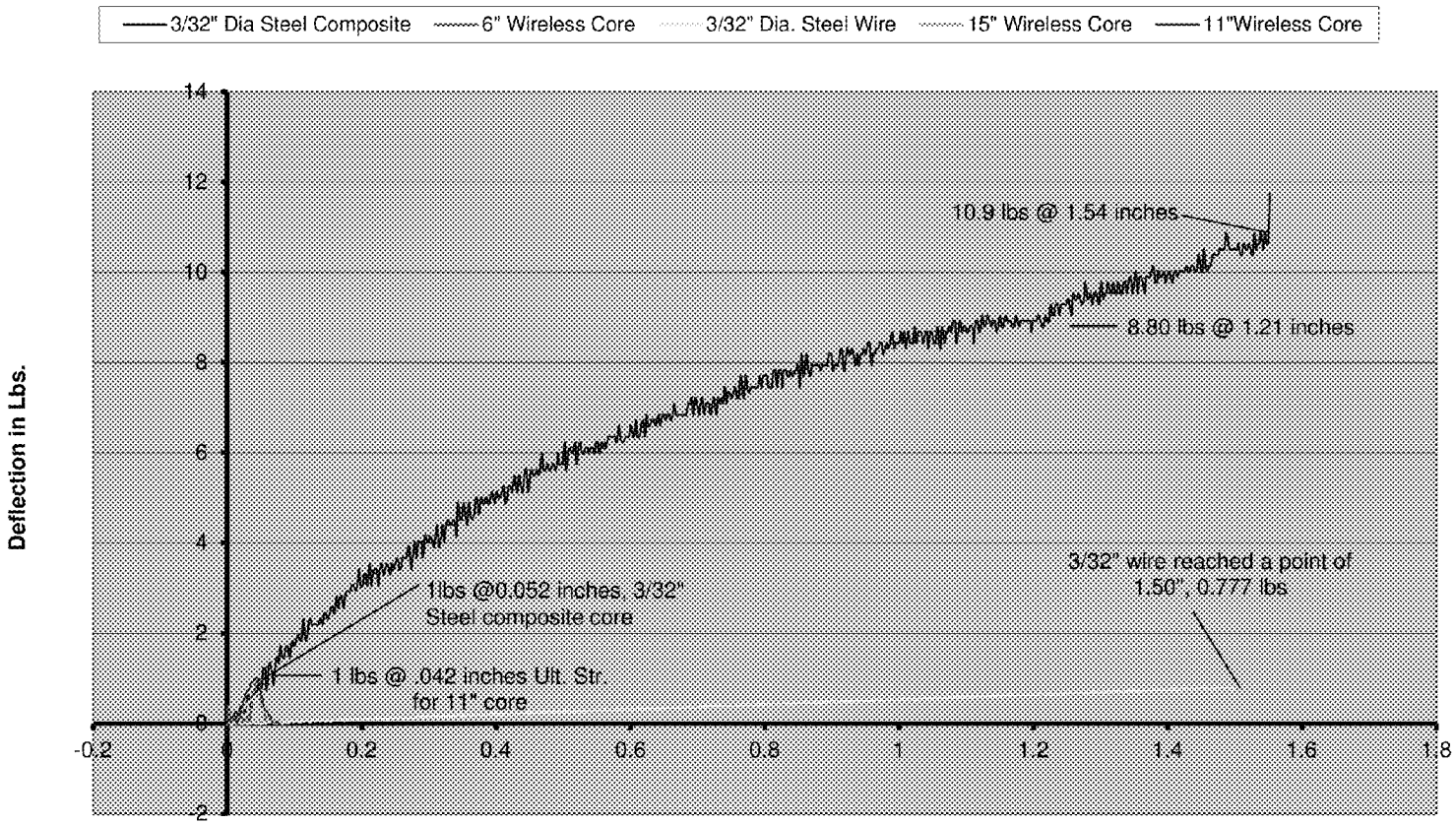
FIG. 10 is a graph of 3/32" steel wire core deflection versus displacement.

The ultimate strength of the 1/8" aluminum composite core reached a point of 1.53" at 10.3 lbs. The 1/8 aluminum wire composite core reached 1 lbs at 0.053" where the 6" wireless core reached ultimate strength at 0.0455" at 11b. The performance of the 1/8" aluminum composite core is similar to the performance of the 3/32" aluminum composite core given in chart 4 (shown in FIG. 10). The wire tested alone reached an ultimate point of 0.66 lbs at 1.50".

Figure 12:
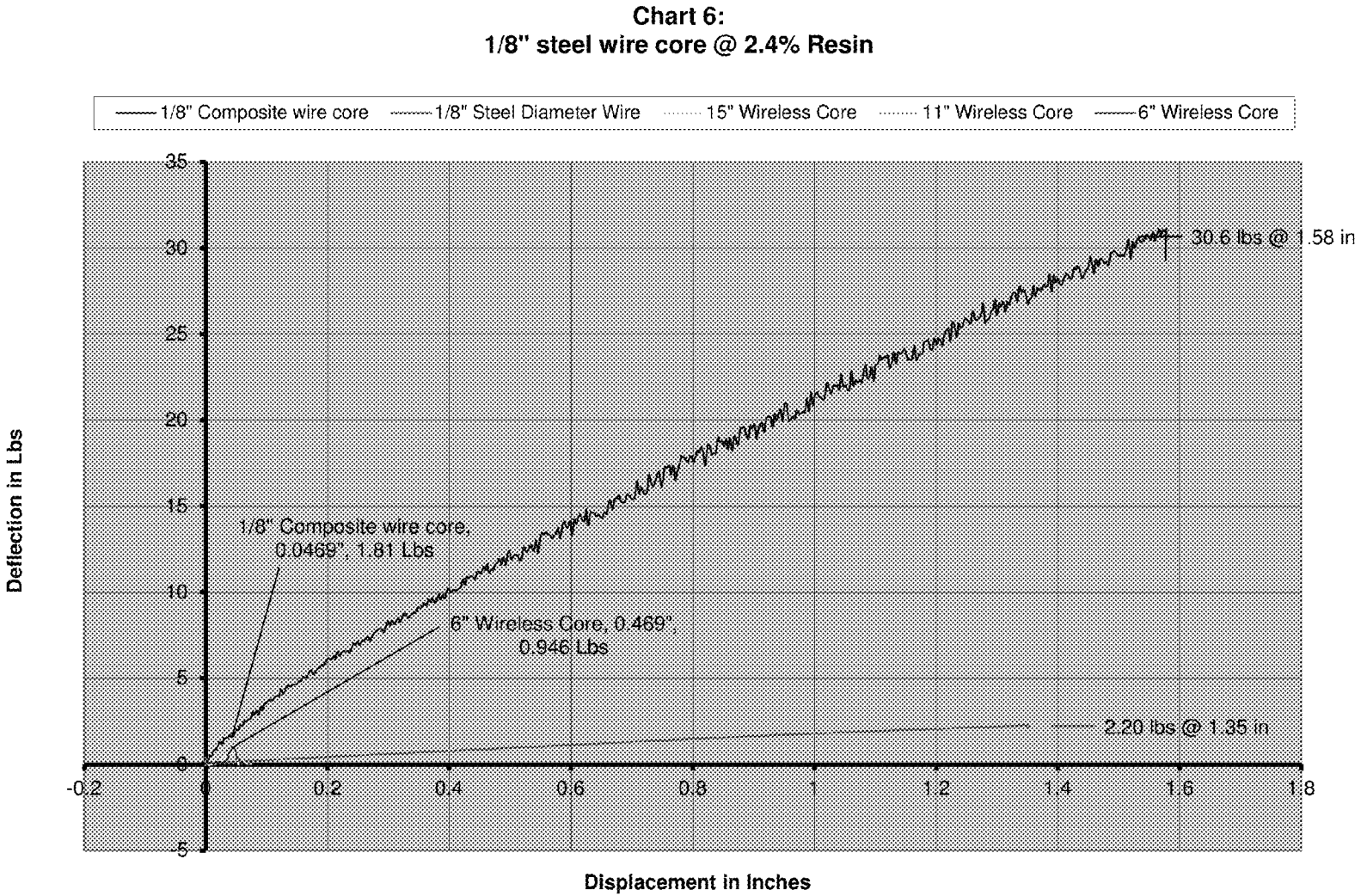
FIG. 12 is a graph of 1/8" steel wire core deflection versus displacement.

Table VI.6a and b indicates what is in the charts regarding the 6", 11", and 15" wireless cores, the 1/8" steel composite core, and the 1/8" diameter steel wire (shown in chart 5 in FIG. 12), in summary form.

TABLE VI.6a (Comparing Wireless Cores to Composite Core)

| Specimen | Displacement | Deflection |
|---|---|---|
| 15" Wireless Core (Ultimate Strength) | 0.0494" | 0.733 lbs |
| 11" Wireless Core (Ultimate Strength) | 0.0420" | 1 lbs |
| 6" Wireless Core (Ultimate Strength) | 0.0455" | 1 lbs |
| 1/8" Composite Core comparing displacement | 0.0350" | 1.344 lbs |
| 1/8" Composite Core at Ultimate Strength (comparing deflection) | 0.0350" | 1.344 lbs |

TABLE VI.2b (Comparing Wire to Composite Core)

| Specimen | Displacement | Deflection |
|---|---|---|
| 1/8" Diameter Wire | 1.35" | 2.20 lbs |
| 1/8" Composite Core comparing displacement | 1.35" | 26 lbs |

The ultimate strength of the 1/8" steel composite core reached a point of 1.58" at 30.6 lbs. The core broke off from the steel wire in the center of the core, on the top side, just before reaching the 1.58" maximum clearance of the jig. The 1/8 steel wire composite core reached 1.344 lbs at 0.035" where the 6" wireless core reached ultimate strength at 0.0455" at 1 lb. This is an increased performance from the 3/32" steel and 1/8" aluminum composite cores gave in charts 4 and 5. The wire tested alone reached an ultimate point of 2.20 lbs at 1.35".

In summary, the order of the composite tests went as follows: 1/16" aluminum, 1/16" steel, 3/32" aluminum, 3/32" steel, 1/8" aluminum, and 1/8" steel. Looking at each chart on each respective performance shows how the composite cores improved from 1/16" aluminum to the 1/8" steel. The performance was a steady improvement as the diameters increased from each of the two materials used. The composite cores surpassed the performance of the ultimate strength of the wireless cores, except for the 1/16" aluminum composite core in chart 1. The performance of the 1/16" aluminum composite core was lacking compared to the other composite cores. The composite cores surpassed the wireless cores by lasting longer than the wireless cores. The wireless cores broke after reaching their respective points of ultimate strength. However, all the composite cores did something the wireless cores did not. The composite cores bent and did not break, except for the 1/16" aluminum composite core and the 1/8" steel composite core. The 1/16" aluminum composite core broke due to the 1/16" aluminum wire was very weak and could not handle being bent at that angle. The 1/8" steel composite core broke due to the opposite extreme compared to the 1/16" aluminum composite core. The 1/8" steel wire inside the composite core applied more resistance than the core surrounding the wire was able to handle and the core broke off revealing the wire underneath during the test. The 1/8" steel composite core surpassed the wireless cores in strength, regardless of the length of the wireless cores. The 3/32" aluminum, 3/32" steel, reached the same performance and the 1/8" aluminum and 1/8" steel composite cores surpassed the performance of resistance than the wireless cores. Fixed end applications of the composite cores would increase the resistance of the performance of the cores. Testing in a fixed end application would need to be performed to determine data for the amount of improvement. The composite cores' performances showed the ability to withstand being taken out of the core-box, placed into the mold, and withstand pouring at being formed at such a long length. The composite core not only reached the similar strength of the wireless cores of 4 of the 6 composite cores scenarios, but did so with wireless cores of a shorter length. Where the wireless cores broke at a low load and short displacement, all of the composite cores lasted at a longer displacement and higher load. The composite cores bending to compensate have the opportunities for applications of cores not yet foreseen.

Making a Casting with the Pre-Tensioned Sand Core Placed Inside.

The sand mold, made out of wood, had sand blown and framed around the wood to create the sand mold. Two pre-tensioned sand cores were placed into the sand mold. Aluminum 356, which is the same Aluminum used for casting cylinder heads and blocks, was melted into liquid form and poured into the mold. During the pouring process, the liquid Aluminum formed around the sand cores. The solidified casting was removed from the sand mold, with the pre-tensioned sand cores inside the casting, forming the desired holes eliminating the need for drilling.

CONCLUSION

The performance of the wires placed inside the 26" long ½" diameter cores increased the strength of the cores. The cores can be removed from the core-box without breakage. The transverse tests showed an increase in performance in the cores with the stronger wires, which included the 3/32" to the ⅛" aluminum and steel. This improved the strength of the cores enough to be placed inside the molds and handle the pouring process of the molten metal. The ⅛" steel had the best performance while the 3/32" aluminum's performance was better than the 15" wireless core.

The thermal simulations showed the heat leaving the core and that the core could handle the wire inside of the core during a forced cooled process for solidifying a casting for both aluminum and cast iron castings. The aluminum wires could not handle the temperatures created by cast iron castings without a forced cooled process. The 3/32" steel and aluminum showed the best performance for thickness of diameter and conductivity.

The 3/32" aluminum and 3/32" steel are the best choices for applying a 26" core in an aluminum casting for strength and thermal properties. The 3/32" steel is the best choice for applying a 26" core in a cast iron casting for strength and thermal properties.

The ability of the composite cores to exceed the wireless cores displacement and bend was an unexpected property. Bending to form different shapes inside a casting will open up new doors for forming a casting never thought of before. Further testing needs to be done. Breakage of a core at this length and diameter is no longer a problem for use of this type of core. Proving that placing a wire in the core to create the composite core solves the problems foundries have experienced with wireless cores of this diameter and length.

In view of the above, it will be seen that the several advantages of the invention are achieved and other advantages attained.

As various changes could be made in the above methods and compositions without departing from the scope of the invention, it is intended that all matter contained in the above description and shown in the accompanying drawings shall be interpreted as illustrative and not in a limiting sense.

All references cited in this specification are hereby incorporated by reference. The discussion of the references herein is intended merely to summarize the assertions made by the authors and no admission is made that any reference constitutes prior art. Applicant reserves the right to challenge the accuracy and pertinence of the cited references.

I claim:

1. A method of making a sand core, the method comprising applying tension to a metal wire within its yield point by pulling the ends of the metal wire away from each other; applying a sand-binder mixture around the metal wire to form a predetermined shape; allowing the sand-binder mixture to harden; and releasing the tension to the metal wire, wherein the metal wire has protrusions sitting perpendicular to the diameter of the metal wire at each end of the wire such that the protrusions enclose the sand-binder mixture where the protrusions compress the sand binder mixture when the tension is released.

2. The method of claim 1, wherein the binder is urethane.

3. The method of claim 1, wherein a catalyst is additionally applied with the sand-binder mixture, wherein the catalyst accelerates the hardening of the sand-binder mixture.

4. The method of claim 1, wherein the shape of the sand core is determined by applying the sand-binder mixture to the wire in a void in a core box, wherein the void of the core box has the predetermined shape.

5. The method of claim 4, wherein the tension to the wire is applied when the wire is placed into the core box.

6. The method of claim 1, wherein the core is a cold core.

7. The method of claim 1, wherein the core is a hot core.

8. The method of claim 1, wherein the core is a thin shell core.

9. The method of claim 1, further comprising placing the sand core in a mold and making a casting in the mold.

10. The method of claim 9, wherein the casting comprises aluminum, cast iron, magnesium or steel.

11. The method of claim 9, wherein the sand core is placed in the mold in a straight shape.

12. The method of claim 9, wherein the sand core is placed in the mold in a curved shape.

13. The method of claim 9, wherein the sand core is placed in the mold in a zigzag shape.

14. The method of claim 9, wherein the sand core is placed in the mold in a chain shape.

15. The method of claim 9, wherein two or more sand cores are placed in the mold, the two or more sand cores connected together.

16. The method of claim 9, wherein the sand core allows heat to vent out of the wire during solidification of the casting.

* * * * *